US011518162B2

(12) United States Patent
Takahashi et al.

(10) Patent No.: US 11,518,162 B2
(45) Date of Patent: Dec. 6, 2022

(54) INFORMATION PROCESSING APPARATUS AND COMPUTER READABLE MEDIUM

(71) Applicant: FUJIFILM Business Innovation Corp., Tokyo (JP)

(72) Inventors: Ryosuke Takahashi, Kanagawa (JP); Yasuhiro Otsuka, Yokohama (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 255 days.

(21) Appl. No.: 17/002,176

(22) Filed: Aug. 25, 2020

(65) Prior Publication Data

US 2021/0245498 A1 Aug. 12, 2021

(30) Foreign Application Priority Data

Feb. 12, 2020 (JP) ..... JP2020-021565

(51) Int. Cl.
*B41J 2/045* (2006.01)

(52) U.S. Cl.
CPC ..... *B41J 2/04508* (2013.01)

(58) Field of Classification Search
CPC ..... B41J 2/04508; B41J 2/21; B41J 2/0456; B41J 2/04586; B41J 2/12
See application file for complete search history.

(56) References Cited

U.S. PATENT DOCUMENTS 9,028,030 B2 * 5/2015 Takekoshi ..... B41J 2/2132 347/15
2021/0245497 A1 * 8/2021 Takahashi ..... B41J 2/04586

FOREIGN PATENT DOCUMENTS

JP 4720274 4/2011

OTHER PUBLICATIONS

English language machine translation of JP 4720274.

* cited by examiner

*Primary Examiner* — Thinh H Nguyen
(74) *Attorney, Agent, or Firm* — Fildes & Outland, P.C.

(57) ABSTRACT

An information processing apparatus includes a processor configured to: acquire physical property information on physical properties of a recording medium and on physical properties of ink to be ejected onto the recording medium and setting information on a setting of a device configured to eject the ink onto the recording medium, the ink including a first ink and a second ink; derive a feature quantity relating to characteristics of the ink based on behavior of the first ink to be ejected onto the recording medium and of the second ink to be ejected to a position adjacent to the first ink ejected, using the physical property information and the setting information; and output information on graininess of an image to be formed on the recording medium based on the feature quantity.

17 Claims, 6 Drawing Sheets

INFORMATION PROCESSING APPARATUS AND COMPUTER READABLE MEDIUM

CROSS-REFERENCE TO RELATED APPLICATIONS

This application is based on and claims priority under 35 USC 119 from Japanese Patent Application No. 2020-21565 filed on Feb. 12, 2020.

BACKGROUND

Technical Field

The present disclosure relates to an information processing apparatus and a computer readable medium.

Related Art

Japanese Patent No. 4720274 discloses an apparatus for simulating a shape of ink dots formed on a print medium at a time of printing a printed image, the apparatus including: a peripheral duty indicating a total amount of ink of ink dots to be formed in a peripheral area set around a pixel of interest; a reference data storage unit that stores dot shape data indicating a relationship with a spread shape of ink dots to be formed in the pixel of interest; a dot data generation unit that generates dot data indicating a formation state of the ink dots of each pixel on the print medium; a dot shape calculation unit that calculates the spread shape of each ink dot to be formed on the print medium according to the dot data by referring to the dot shape data; and an image quality evaluation index calculation unit that calculates an image quality evaluation index for evaluating an image quality of the print based on the spread shape of each ink dot calculated by the dot shape calculation unit.

SUMMARY

In an ink jet recording type image forming apparatus, there is a technique of predicting granular regularity (graininess) of ink to be ejected onto a recording medium by simulating a behavior of the ink that wets the recording medium and spreads on the recording medium when the ink is ejected onto the recording medium, and of evaluating an image to be formed using the graininess.

However, the number of ink droplets ejected onto the recording medium is enormous, and enormous calculation processing is required to simulate a behavior of each ink for an entire region to be printed. Since the behavior of the ink changes according to setting information at a time of printing that is related to the recording medium, the ink, and the like, it takes a lot of time to reflect printing conditions and simulate the accurate behavior of the ink.

Aspects of non-limiting embodiments of the present disclosure relate to an information processing apparatus and a computer readable medium storing a program with which processing time for deriving information on graininess of an image to be formed on a recording medium may be reduced, as compared with a case of simulating a behavior of each ink for an entire region to be printed.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an information processing apparatus including a processor configured to: acquire physical property information on physical properties of a recording medium and on physical properties of ink to be ejected onto the recording medium and setting information on a setting of a device configured to eject the ink onto the recording medium, the ink including a first ink and a second ink; derive a feature quantity relating to characteristics of the ink based on behavior of the first ink to be ejected onto the recording medium and of the second ink to be ejected to a position adjacent to the first ink ejected, using the physical property information and the setting information; and output information on graininess of an image to be formed on the recording medium based on the feature quantity.

BRIEF DESCRIPTION OF DRAWINGS

Exemplary embodiment(s) of the present invention will be described in detail based on the following figures, wherein.

DETAILED DESCRIPTION

An exemplary embodiment of the present disclosure will be described in detail below with reference to the drawings. An information processing apparatus 10 according to the present exemplary embodiment is, for example, a server configured to acquire a setting value from an image forming apparatus and to evaluate an image to be formed using acquired information. However, the present invention is not limited thereto. The information processing apparatus 10 may be, for example, a terminal such as a personal computer and a tablet, or an image forming apparatus.

Figure 1:
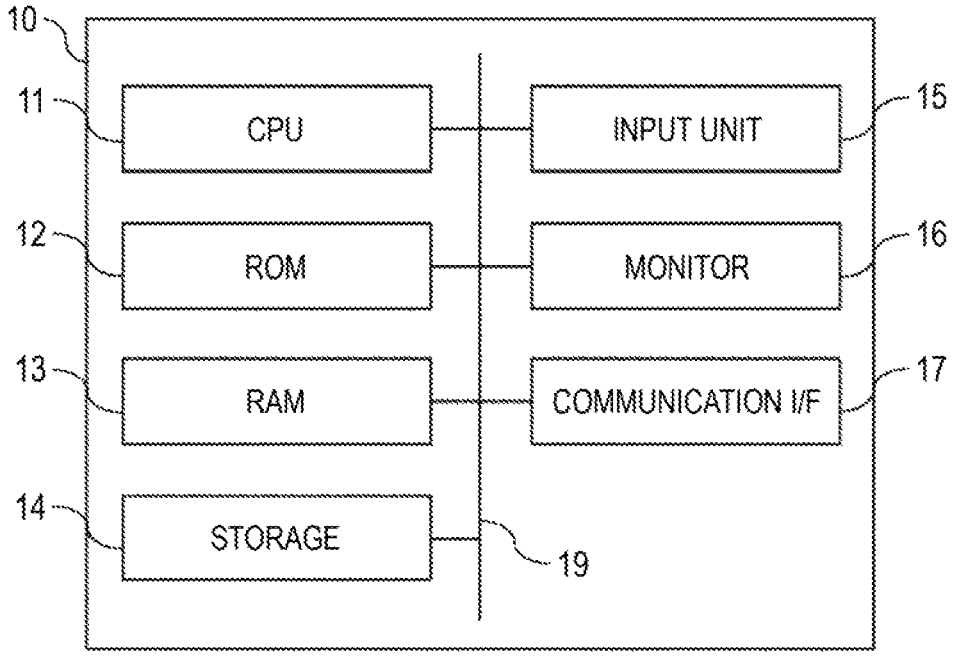
FIG. 1 is a block diagram showing an example of a hardware configuration of an information processing apparatus according to an exemplary embodiment.

A hardware configuration of the information processing apparatus 10 will be described with reference to FIG. 1. FIG. 1 is a block diagram showing an example of the hardware configuration of the information processing apparatus 10 according to the present exemplary embodiment. As shown in FIG. 1, the information processing apparatus 10 according to the present exemplary embodiment includes a central processing unit (CPU) 11, a read only memory (ROM) 12, a random access memory (RAM) 13, a storage 14, an input unit 15, a monitor 16, and a communication interface (communication I/F) 17. The CPU 11, the ROM 12, the RAM 13, the storage 14, the input unit 15, the monitor 16, and the communication I/F 17 are connected to one another by a bus 19. Here, the CPU 11 is an example of a processor.

The CPU 11 is configured to control the entire information processing apparatus 10. The ROM 12 is configured to store various programs and data including an information processing program used in the present exemplary embodiment. The RAM 13 is a memory used as a work area when the various programs are executed. The CPU 11 is configured to execute information processing by loading the program stored in the ROM 12 into the RAM 13 and executing the program. The storage 14 is, for example, a hard disk drive (HDD), a solid state drive (SSD), a flash memory, or the like. The storage 14 may store information related to the information processing program and various data acquired from the image forming apparatus. The input unit 15 is a mouse and a keyboard that are configured to input characters and the like. The monitor 16 is configured to display image data, characters, and the like. The communication I/F 17 is configured to transmit and receive data.

Figure 2:
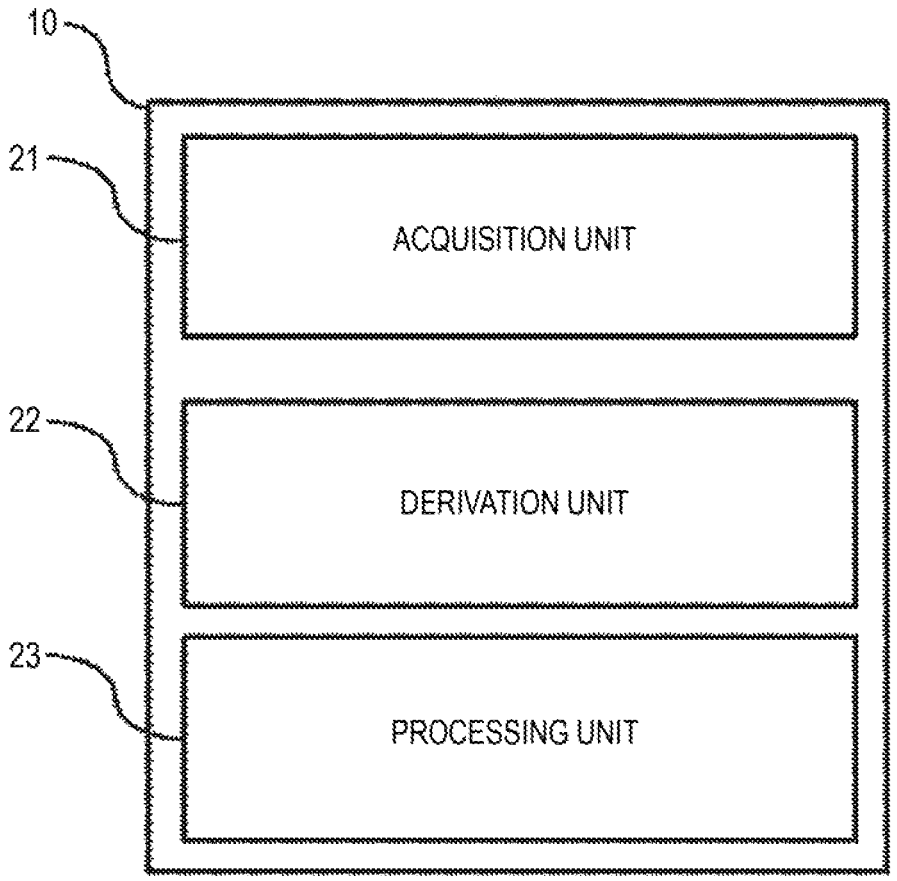
FIG. 2 is a block diagram showing an example of a functional configuration of the information processing apparatus according to the present exemplary embodiment.

Next, a functional configuration of the information processing apparatus 10 will be described with reference to FIG. 2. FIG. 2 is a block diagram showing an example of the functional configuration of the information processing apparatus 10 according to the present exemplary embodiment.

As shown in FIG. 2, the information processing apparatus 10 includes an acquisition unit 21, a derivation unit 22, and a processing unit 23. The CPU 11 executes the information processing program to function as the acquisition unit 21, the derivation unit 22, and the processing unit 23.

The acquisition unit 21 is configured to acquire information (hereinafter referred to as "physical property information") on physical properties of a recording medium and physical properties of an ink to be ejected onto the recording medium and information (hereinafter referred to as "setting information") on a setting of the image forming apparatus that ejects the ink onto the recording medium. Here, the physical properties of the recording medium acquired by the acquisition unit 21 are, for example, surface tension, an average pore diameter, and surface uneven shape distribution of the recording medium, and the physical properties of the ink are surface tension and viscosity of the ink. The setting of the image forming apparatus is a volume of the ink to be ejected, a distance between nozzles, a printing speed, a distance between heads, and a ratio (hereinafter referred to as "image density") of a region where the ink is ejected to the recording medium.

The derivation unit 22 is configured to derive a feature quantity relating to characteristics of the ink based on behaviors of a first drop of the ink to be ejected onto the recording medium and of a second drop of the ink and subsequent drops of the ink to be ejected to a position adjacent to the first drop of the ink, using the physical property information and the setting information. Here, the first drop of the ink is an example of a first ink, and the second drop of the ink and the subsequent drops of the ink are an example of a second ink.

Specifically, the derivation unit 22 derives, as the feature quantity, a periodic size of the inks formed by continuously contacting the inks and a probability of forming the periodic size. When the inks contact one another, one ink aggregate having a certain size is formed, and plural ink aggregates having a similar size are formed on the recording medium. The derivation unit 22 derives a size of the ink aggregate and a probability of forming a periodic size. In the present exemplary embodiment, the size of the ink aggregate that is formed by the inks contacting one another is referred to as the "periodic size". In the following description, a fact that the inks contact with one another and overlap is referred to as "coalescence".

The derivation unit 22 derives the probability of forming the periodic size using an amount of deviation between a position at which the ink is ejected and a position of the ejected ink that has moved due to a state of the recording medium, and an overlapping amount when the first drop of the ink and the second or subsequent drop of the ink are in contact with one another. Hereinafter, the amount of deviation between the position at which the ink is ejected and the position of the ejected ink that has moved due to the state of the recording medium is referred to as an "amount of deviation generated due to the recording medium", and the overlapping amount when the first drop of the ink and the second drop of the ink and the subsequent drops of the ink coalesce and are in contact with one another is referred to as an "overlapping amount". The amount of deviation generated due to the recording medium is derived using a wetting and spreading width of the ink and a contact angle of the ink. The amount of deviation generated due to the recording medium is an example of the first deviation amount.

The derivation unit 22 derives the periodic size using the probability of forming the periodic size and the amount of deviation of the ink that has moved due to the coalescence of the first drop of the ink and the second drop of the ink. The amount of deviation of the ink that has moved due to the coalescence is an example of the second deviation amount.

The derivation unit 22 derives a value (hereinafter referred to as a "visual characteristic") for evaluating perception of the ink ejected onto the recording medium by the user, using the periodic size. The derivation unit 22 also derives a value indicating the regularity (hereinafter referred to as "graininess") of the ink ejected onto the recording medium based on the visual characteristic.

The processing unit 23 is configured to evaluate the graininess of an image to be formed on the recording medium. Specifically, when the graininess exceeds a predetermined threshold value, the processing unit 23 notifies a user that a quality of the image is poor, or of the setting information (for example, the printing speed and the image density) to set the graininess to be lower than the predetermined threshold value. A mode has described in which the processing unit 23 according to the present exemplary embodiment performs the notification when the graininess exceeds the predetermined threshold value. However, the present invention is not limited thereto. When a value indicating the graininess exceeds the threshold value, the processing unit 23 may change the setting information to correct the graininess to the threshold value or lower. Specifically, the processing unit 23 may correct at least one of the printing speed and the image density included in the setting information to correct the graininess to the threshold value or lower.

Next, a method of evaluating the graininess according to the present exemplary embodiment will be described with reference to FIGS. 3 to 7 before operation of the information processing apparatus 10 is described.

Figure 3:
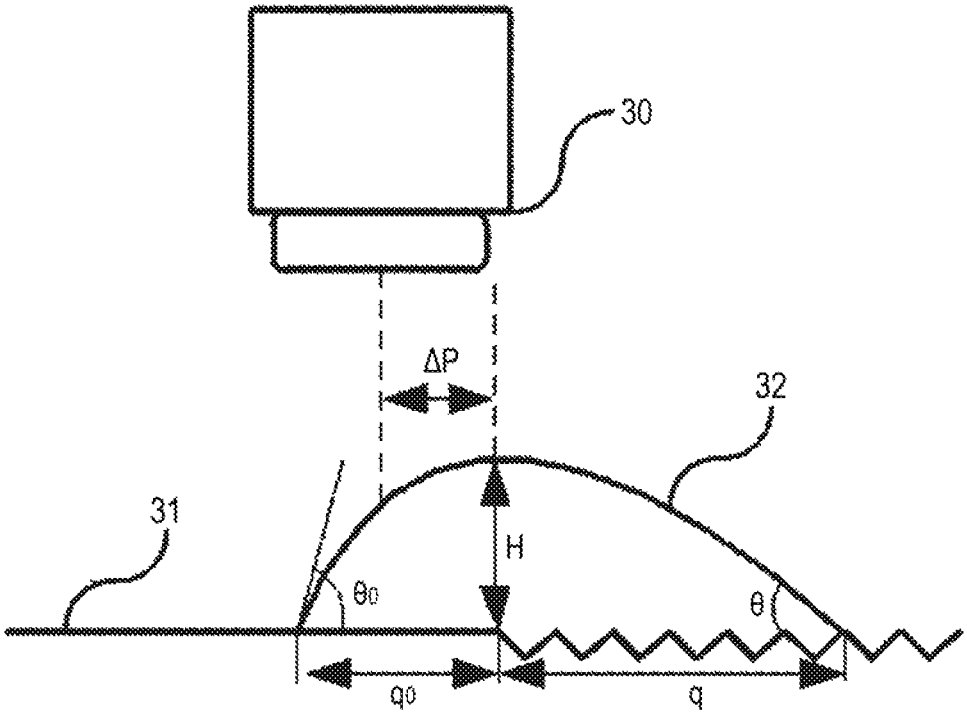
FIG. 3 is a schematic diagram showing an example of ejected droplets for describing a contact angle according to the present exemplary embodiment.

First, a method of deriving the amount of deviation generated due to the recording medium of the ink will be described with reference to FIG. 3. FIG. 3 is a schematic diagram showing an example of ejected droplets for describing the contact angle according to the present exemplary embodiment.

As an example, as shown in FIG. 3, an ink 32 ejected from a nozzle 30 of the image forming apparatus to a recording medium 31 may deviate from a position of the ink 32 after being ejected from the nozzle 30, due to a state of a recess or the like present on the recording medium 31. FIG. 3 shows the derivation of an amount of deviation of the ink 32 when one drop of the ink 32 is ejected on a boundary between a smooth surface of the recording medium 31 and an uneven surface which is a recess or the like of the recording medium 31.

The information processing apparatus 10 acquires physical property information (an average pore diameter and surface uneven shape distribution of the recording medium 31, viscosity of the ink 32, surface tension, and the like). Here, the surface tension includes surface tension of the recording medium 31, surface tension of the ink 32, and surface tension between the recording medium 31 and the ink 32. A mode has been described in which the information processing apparatus 10 according to the present exemplary embodiment acquires the average pore diameter and the surface uneven shape distribution of the recording medium 31, the viscosity of the ink, and the surface tension as the physical property information. However, the present invention is not limited thereto. The information processing apparatus 10 may acquire information on physical properties which are an electrical resistance value, electrical conductivity, electrical polarizability, and the like of the recording medium 31 and the ink 32 as the physical property information.

The information processing apparatus 10 acquires the setting information of the image forming apparatus.

The information processing apparatus 10 derives, using the acquired physical property information, the contact angle between the recording medium 31 and the ink 32, a permeation coefficient when the ink 32 permeates the recording medium 31, and a ratio (Wentzel's roughness factor) of an actual surface area to an apparent surface area of the recording medium 31. The contact angle, the permeation coefficient, and the ratio of an actual surface area to an apparent surface area of the recording medium 31 are expressed by the following equations.

$$\cos\theta_0 = \frac{\sigma_s - \sigma_{fs}}{\sigma_f} \tag{1}$$

$$\beta = \sqrt{\frac{r\sigma_f \cos\theta_0}{2\mu}} \tag{2}$$

$$\cos\theta = S\cos\theta_0 \tag{3}$$

Here, $\theta_0$ is the contact angle of the ink 32 in contact with the smooth surface on the recording medium 31, $\sigma_{fs}$ is the surface tension of the recording medium 31, $\sigma_f$ is the surface tension of the ink 32, and $\sigma_{fs}$ is the surface tension between the recording medium 31 and the ink 32. $\beta$ is the permeation coefficient, r is the average pore diameter of the recording medium 31, $\mu$ is the viscosity of the ink 32, $\theta$ is the contact angle of the ink 32 in contact with the uneven surface of the recording medium 31, and S is the ratio (S>1) of the actual surface area to the apparent surface area of the recording medium 31.

As shown in FIG. 3, a distance from a position where a perpendicular line is drawn from a vertex of the ink 32 to a plane of the recording medium 31 to an edge of the ink 32 that is in contact with the smooth surface of the recording medium 31 is defined as $q_0$, and a distance from the position where the perpendicular line is drawn from the vertex of the ink 32 to the plane of the recording medium 31 to an edge of the ink 32 that is in contact with the uneven surface of the recording medium 31 is defined as q. The amount of deviation of the apex of the ejected ink 32 that has moved due to the uneven surface of the recording medium 31 or the like is expressed by the following equations.

$$\Delta P = \frac{q - q_0}{2} \tag{4}$$

$$\tan\theta_0 = \frac{2H}{q_0} \tag{5}$$

$$V_0 = \frac{\pi}{6}H\left\{3\left(\frac{q_0}{2}\right)^2 + H^2\right\} \tag{6}$$

Here, $\Delta P$ is the amount of deviation of the vertex of the ejected ink 32 that has moved due to the uneven surface of the recording medium 31 or the like, H is a height of the vertex of the ink 32, and V is a volume of the ink 32.

That is, using Equation (1), Equation (3), Equation (5) and Equation (6), the amount $\Delta P$ of deviation of the ink 32 is expressed using the ratio S of the actual surface area to the apparent surface area of the recording medium 31, the volume $V_0$, and the surface tension, and the amount $\Delta P$ of deviation is derived using the acquired physical property information.

Figure 4:
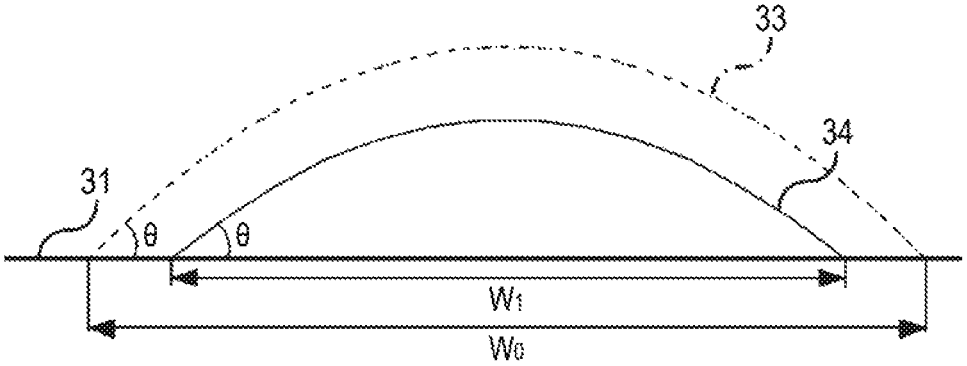
FIG. 4 is a schematic diagram showing an example of the ejected droplets for describing a wetting and spreading width according to the present exemplary embodiment.

Next, a method of deriving the wetting and spreading width of the ink will be described with reference to FIG. 4. FIG. 4 is a schematic diagram showing an example of the ejected droplets for describing the wetting and spreading width according to the present exemplary embodiment.

An ink 33 ejected from the nozzle 30 onto the recording medium 31 permeates the recording medium 31 as time elapses, and a volume of the ink 34 present on the recording medium 31 decreases as compared with a volume of the ink 33 immediately after the ejection. A wetting and spreading width of the ink 33 immediately after being ejected onto the recording medium 31 is derived using the following equations.

$$\tan\theta_0 = \frac{2H}{W_0} \tag{7}$$

$$V_0 = \frac{\pi}{6}H\left\{3\left(\frac{W_0}{2}\right)^2 + H^2\right\} \tag{8}$$

Here, $W_0$ is the wetting and spreading width of the ink 33 immediately after being ejected onto the recording medium 31, and $V_0$ is the volume of the ink 33 immediately after being ejected onto the recording medium 31.

The wetting and spreading width immediately after being ejected onto the recording medium 31 is derived using Equations (7) and (8) described above. When an amount of the ink permeating the recording medium 31 as time elapses is subtracted from the volume $V_0$, the volume of the ink 34 when any time has elapsed is derived, and the wetting and spreading width when any time has elapsed is derived from the volume of the ink 34.

In the present exemplary embodiment, after the first drop of the ink has been ejected, the graininess of the image is evaluated using the feature quantity when the second drop of the ink is ejected. Therefore, when any time is time from the ejection of the first drop of the ink to the ejection of the second drop of the ink, the time from the ejection of the first drop of the ink to the ejection of the second drop of the ink is expressed by the following equation.

$$t_2 = \frac{v}{d_h} \tag{9}$$

Here, $t_2$ is the time from the ejection of the first drop of the ink to the ejection of the second drop of the ink, v is a printing speed at which the second drop of the ink is ejected after the first drop of the ink is ejected, and $d_h$ is a distance between the heads. When it is considered that the ink that permeates the recording medium 31 decreases as time elapses, the time from the ejection of the first drop of the ink to the ejection of the second drop of the ink is expressed by the following equation.

$$t_2 = \exp\left(-k_1 \frac{v}{d_h}\right) \tag{10}$$

Here, $k_1$ is any coefficient. $k_1$ is derived in consideration of a contact area of the recording medium 31, a filling degree of a gap on the recording medium 31, and the like.

The amount of the ink which has permeated the recording medium 31 is expressed by the following equation using Equations (2) and (9) or (10) described above and the wetting and spreading width $W_0$ immediately after the ejection.

$$\Delta V = \frac{\pi}{4}\beta\sqrt{t_2}\,W_0^2 \tag{11}$$

Here, ΔV in Equation (11) represents the amount of the ink permeating the recording medium 31 when the time from the ejection of the first drop of the ink to the ejection of the second drop of the ink from the surface where the ink 33 immediately after the ejection is in contact with the recording medium. Therefore, the volume of the ink 34 when the time from the ejection of the first drop of the ink to the ejection of the second drop of the ink has elapsed is expressed by the following equation.

$$V_1 = V_0 - \Delta V \tag{12}$$

Here, $V_1$ is the volume of the ink 34 present on the recording medium 31 when the time from the ejection of the first drop of the ink to the ejection of the second drop of the ink has elapsed.

Therefore, the wetting and spreading width of the ink 34 is derived by applying the volume $V_1$ of the ink 34 to the following equations.

$$\tan\theta = \frac{2H_1}{W_1} \tag{13}$$

$$V_1 = \frac{\pi}{6}H_1\left\{3\left(\frac{W_1}{2}\right)^2 + H_1^2\right\} \tag{14}$$

Here, $H_1$ is a height of a vertex of the ink 34, and $W_1$ is the wetting and spreading width of the ink 34. Therefore, the wetting and spreading width of the ink 34 when the time from the ejection of the first drop of the ink to the ejection of the second drop of the ink has elapsed is derived using the physical property information and the setting information.

Figure 5:
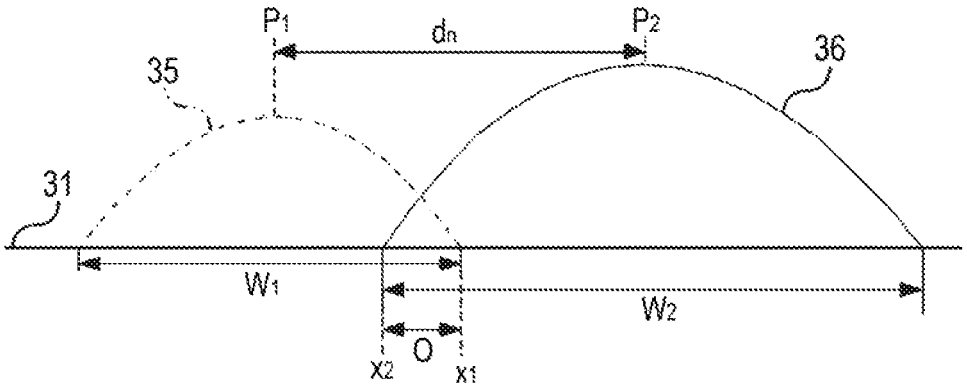
FIG. 5 is a schematic diagram showing an example of two ejected droplets for describing an overlapping amount according to the present exemplary embodiment.

Next, a method of deriving the overlapping amount of the inks will be described with reference to FIG. 5. FIG. 5 is a schematic diagram showing an example of two ejected droplets for describing the overlapping amount according to the present exemplary embodiment.

As shown in FIG. 5, when a second drop of an ink 36 is ejected to a position adjacent to a first drop of an ink 35 that has been ejected onto the recording medium 31, respective positions of the ink 35 and the ink 36 overlap each other, and thus coalescence occurs. As shown in FIG. 5, an overlapping amount of respective edges of the ink 35 and the ink 36 is derived using the positions to which the ink 35 and the ink 36 have been ejected and the setting information. A position of the edge of the ink 35, a position of a vertex to which the ink 36 is ejected, and a position of the edge of the ink 36 that is adjacent to the ink 35 are expressed by the following equations.

$$x_1 = P_1 + \frac{W_1}{2} \tag{15}$$

$$P_2 = P_1 + d_n \tag{16}$$

$$x_2 = P_2 - \frac{W_2}{2} \tag{17}$$

Here, $x_1$ is the position of the edge of the ink 35, $P_1$ is a position of a vertex of the ink 35, $P_2$ is a position of a vertex of the ink 36, and $d_n$ is a distance between the nozzles. $x_2$ is a position of the edge of the ink 36 that is adjacent to the ink 35, and $W_2$ is the wetting and spreading width of the ink 36. Therefore, the positions of the respective edges of the ink 35 and the ink 36 are derived using the position of the vertex of the ink 35 and the setting information. The overlapping amount of the ink 35 and the ink 36 is expressed by the following equation using the positions of the respective edges of the ink 35 and the ink 36.

$$O = x_1 - x_2 \tag{18}$$

Here, O is the overlapping amount of the ink 35 and the ink 36.

That is, when the position $P_1$ of the vertex of the ink 35 is determined, the position $x_1$ of the edge of the ink 35, the position $P_2$ of the vertex of the ink 36, and the position $x_2$ of the edge of the ink 36 are derived, and the overlapping amount O is derived. Here, the position P1 of the vertex of the ink 35 is derived from a position of the nozzle which is an origin and the amount ΔP of deviation, and thus is derived using the physical property information and the setting information. In order to avoid complication, the present exemplary embodiment does not describe the position P2 of the vertex of the ink 36 in consideration of the amount ΔP of deviation when the ink 36 is ejected onto the recording medium 31. However, the position of the vertex of the ink 36 may be derived in consideration of the amount ΔP of deviation.

When the inks coalesce with each other, since one ink is attracted to the other ink, or each of the inks is attracted toward an overlapping position, the position of the ink may be changed.

Figure 6:
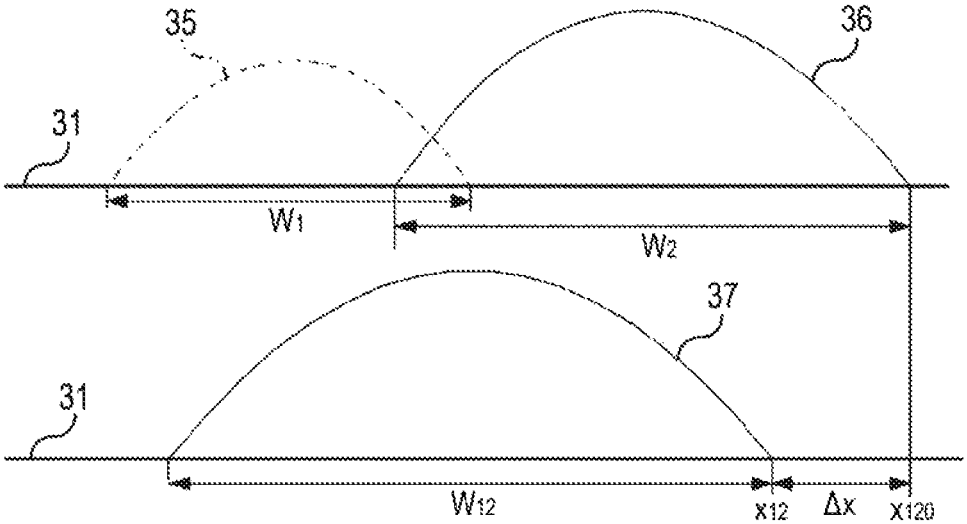
FIG. 6 is a schematic diagram showing an example of the two ejected droplets for describing a change amount of the droplets in a case of coalescence according to the present exemplary embodiment.

Next, derivation of a change amount of the position of the ink in a case of coalescence will be described with reference to FIG. 6. FIG. 6 is a schematic diagram showing an example of the two ejected droplets for describing the change amount of the droplets in the case of coalescence according to the present exemplary embodiment. An upper part of FIG. 6 shows an example when the ink 35 and the ink 36 coalesce, and a lower part of FIG. 6 shows an example when the ink 35 and the ink 36 become one ink 37.

As shown in the lower part of FIG. 6, when the ink 35 and the ink 36 coalesce and become one droplet, the positions of the edges of the ink 35 and the ink 36 change. As shown in FIG. 6, the position of the edge of the ink 36 and a position of an edge of the ink 37 that has coalesced into one droplet are used to derive the change amount of the position in the case of coalescence. The ink 37, which has coalesced into one droplet, is derived by the following equations.

$$V_{12} = V_1 + V_2 \tag{19}$$

$$\tan\theta = \frac{2H_{12}}{W_{12}} \tag{20}$$

$$V_{12} = \frac{\pi}{6}H_{12}\left\{3\left(\frac{W_{12}}{2}\right)^2 + H_{12}^2\right\} \tag{21}$$

$$P_{12} = \frac{P_1V_1 + P_2V_2}{V_1 + V_2} \tag{22}$$

$$x_{12} = P_{12} + \frac{W_{12}}{2} \tag{23}$$

Here, $V_{12}$ is a volume of the ink 37 that has coalesced into one droplet, $W_{12}$ is the wetting and spreading width of the ink 37, $H_{12}$ is a height of the vertex of the ink 37, $P_{12}$ is a position of the vertex of the ink 37, and $x_{12}$ is the position of the edge of the ink 37.

As shown in Equation (23) described above, the position $x_{12}$ of the edge of the coalesced ink 37 is derived using the position $P_{12}$ of the vertex of the ink 37 and the wetting and spreading width $W_{12}$ of the ink 37. The position $P_{12}$ of the vertex of the ink 37 is derived as in Equation (22) described above in consideration of the volume $V_1$ of the ink 35 and the position $P_1$ of the vertex, and the volume $V_2$ of the ink 36 and the position $P_2$ of the vertex. The wetting and spreading width $W_{12}$ of the ink 37 is derived using Equations (19), 20, and 21 described above.

The position of the edge of the ink 36 is expressed by the following equation.

$$x_{120} = P_2 + \frac{W_2}{2} \tag{24}$$

Here, $x_{120}$ is a position of the edge of the ink 36 corresponding to the edge of the ink 37. That is, the ink 35 and the ink 36 coalesce, so that the position $x_{120}$ of the edge moves to the position $x_{12}$ of the edge. Therefore, the change amount of the position of the edge when the inks coalesce is expressed by the following equation.

$$\Delta x = x_{120} - x_{12} \tag{25}$$

Here, $\Delta x$ is the change amount of the position of the edge when the inks coalesce.

The periodic size, the probability of forming the periodic size, and an L noise for evaluating the graininess of the image are derived using the amount $\Delta P$ of deviation of the vertex, the overlapping amount O of the ink, and a change amount $\Delta x$ of the position that are described above. First, the probability of forming the periodic size will be described.

First, a case in which the second drop of the ink is ejected to both ends of the first drop of the ink will be described. In the case in which the second drop of the ink is ejected to both ends of the first drop of the ink, a probability that the second drop of the ink is ejected to both ends of the first drop of the ink is expressed by the following equation. A frequency with which the first ink and the second ink coalesce and the first drop of the ink moves in either direction of the second drop of the ink that has been ejected to both ends is expressed by the following equations.

$$R_b = \left(\frac{C_{in}}{100}\right)^2 \tag{26}$$

$$\alpha_1 = \frac{\Delta P}{O} \tag{27}$$

Here, $R_b$ is the probability that the second ink is ejected to both ends of the first drop of the ink, $c_m$ is the image density, and $\alpha_1$ is the frequency with which the first drop of the ink moves in either direction of the second drop of the ink that has been ejected to both ends.

From Equation (26) described above, $R_b$ indicates the probability that the second ink is ejected to both ends of the first drop of the ink. From Equation (27) described above, the frequency at indicates that the larger the amount $\Delta P$ of deviation of the ink or the smaller the overlapping amount O, the more frequently the first drop of the ink deviates to one direction of the second drop of the ink.

By multiplying the probability $R_b$ and the frequency $\alpha_1$, a probability that coalescence (hereinafter referred to as "asymmetric coalescence") occurs in which contact between the inks is interrupted in a case in which the second drop of the ink is ejected to both ends of the first drop of the ink is derived. The probability of the asymmetric coalescence is expressed by the following equation.

$$R_1 = \alpha_1 \cdot R_b \tag{28}$$

Next, the case will be described in which the second drop of the ink is ejected to one of both ends of the first drop of the ink. In the case in which the second drop of the ink is ejected to one of both ends of the first drop of the ink, a probability that the second drop of the ink is ejected to one of both ends of the first drop of the ink and a frequency of the coalescence are expressed by the following equations.

$$R_s = \frac{C_{in}}{100}\left(1 - \frac{C_{in}}{100}\right) \tag{29}$$

$$\alpha_2 = \frac{O}{d_n} \tag{30}$$

Here, $R_s$ is the probability that the second drop of the ink is ejected to one of both ends of the first drop of the ink, and $\alpha_2$ is the frequency with which the coalescence occurs when the second drop of the ink is ejected to one of both ends of the first drop of the ink. From Equation (30) described above, the frequency $\alpha_2$ indicates that the larger the overlapping amount O and the smaller the distance between the nozzles, the more frequently the coalescence occurs.

By multiplying the probability $R_s$ and the frequency $\alpha_2$, a probability that the coalescence occurs at one of both ends of the ink, and that the ink is not ejected to the other end of the ink, the contact between the inks is interrupted, and the asymmetric coalescence occurs is derived. In the case in which the second drop of the ink is ejected to one of both ends of the first drop of the ink, the probability that the asymmetric coalescence occurs is expressed by the following equation.

$$R_2 = \alpha_2 \cdot R_S \tag{31}$$

By adding Equations (28) and (31) described above, a probability is derived that, when the second drop of the ink is ejected to both ends of the first drop of the ink or when the second drop of the ink is ejected to one of both ends of the first drop of the ink, the asymmetric coalescence occurs and the periodic size is formed. The probability of forming the periodic size is expressed by the following equation.

$$R=R_1+R_2 \tag{32}$$

Next, the periodic size will be described. The periodic size is derived by multiplying the distance between the nozzles by an expected value (a reciprocal of the image density $C_{in}$) for ejecting the ink and an expected value (a reciprocal of the probability R of forming the periodic size) for forming the periodic size. The periodic size L is expressed by the following equation.

$$L = d_n \cdot \frac{100}{100 - C_{in}} \cdot \frac{1}{R} \tag{33}$$

The periodic size L changes depending on the physical properties of the ink, which are the viscosity p of the ink, the uneven shape distribution of the recording medium 31, and the like, and the physical properties of the recording medium 31. Therefore, the periodic size L may be expressed as the following equation in consideration of the physical properties of the ink and the physical properties of the recording medium 31.

$$L = k_2 \cdot d_n \cdot \frac{100}{100 - C_{in}} \cdot \frac{1}{R} + k_3 \tag{34}$$

Here, $k_2$ and $k_3$ are any coefficient, and are determined by the physical properties of the ink and the recording medium 31.

Next, the visual characteristic indicating a sensory evaluation of the ink ejected onto the recording medium 31 that is perceived by a user, and the graininess indicating the regularity (randomness of a margin of the recording medium and the deposited ink) of the ink having the periodic size will be described. The visual characteristic and the graininess are expressed by the following equations.

$$f = 5.05\left\{\exp\left(-\frac{0.843}{L}\right) - \exp\left(-\frac{1.454}{L}\right)\right\} \tag{35}$$

$$L^* = \Delta x \cdot R \cdot f \cdot k_4 + k_5 \tag{36}$$

Here, f is the visual characteristic, exp is a base (a Euler number) of a natural logarithm. L* is the graininess, and $k_4$ and $k_5$ are any coefficient. Since the regularity easily recognized by the user is different depending on colors of the ink and the recording medium 31, $k_4$ and $k_5$ are determined according to the colors of the ink and the recording medium 31.

Here, the sensory evaluation indicates a correlation between a spatial frequency (for example, a width of a stripe in a striped image) and a sensitivity related to brightness recognized by the user. If the spatial frequency (the periodic size L) is larger than a specific range or smaller than the specific range, it is difficult for the user to recognize a difference in brightness. That is, if the spatial frequency (the periodic size L) is large, it is difficult for the user to identify different inks even if inks of different brightness are mixed. However, it is known that when the spatial frequency (the periodic size L) is within the specific range, the user may easily recognize the difference in brightness. The visual characteristic according to the present exemplary embodiment is defined as indicated in Equation (35) described above so as to be compatible with the sensory evaluation recognized as a well-known technique.

The graininess in consideration of a ratio between the ink and a margin of the recording medium 31 is expressed by the following equation.

$$L^* = \Delta x \cdot R \cdot f \cdot \sqrt{\frac{C_{in}}{100}} \cdot k_4 + k_5 \tag{37}$$

As in Equation (36) or (37) described above, the graininess L* is expressed using the change amount Δx, the probability R of forming the periodic size, and a visual characteristic f. That is, the larger the change amount of ink movement, the greater the probability R of forming the periodic size, or the greater the visual characteristic, the greater the graininess of the ink is.

That is, Equation (36) or (37) indicates that the greater the graininess, the more ink arrangement is recognized to be disturbed.

Figure 7:
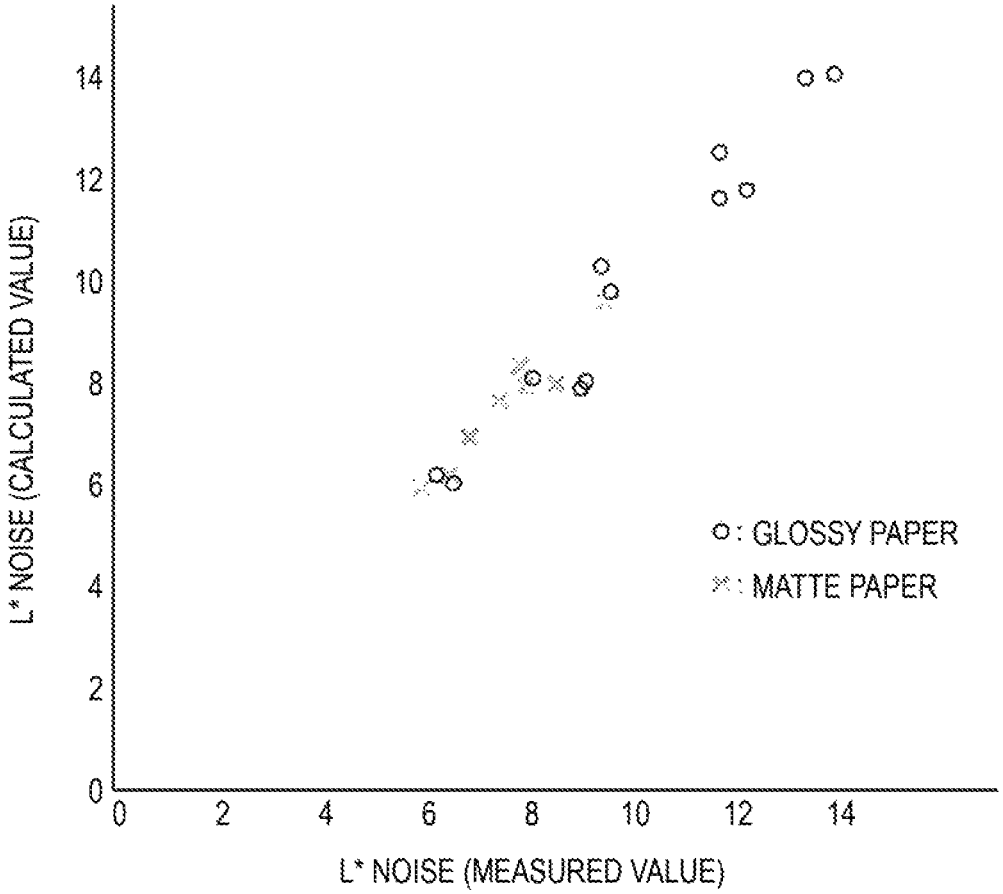
FIG. 7 is a graph showing an example of measured values and calculated values of an L* noise according to the present exemplary embodiment.

FIG. 7 is a graph showing an example of measured values and calculated values of an L* noise according to the present exemplary embodiment. FIG. 7 shows that there is a correlation between the measured values and the calculated values of the graininess (the L* noise) when a glossy paper or a matte paper is used as the recording medium 31.

As shown in FIG. 7, it may be apparent that a difference between the L* noise (the calculated values of the L noise) according to the present exemplary embodiment and the measured values of the L* noise is sufficiently small. That is, FIG. 7 shows that the graininess of an image to be formed on the recording medium may be evaluated statistically from the behaviors of the first and second drops of the ink.

Figure 8:
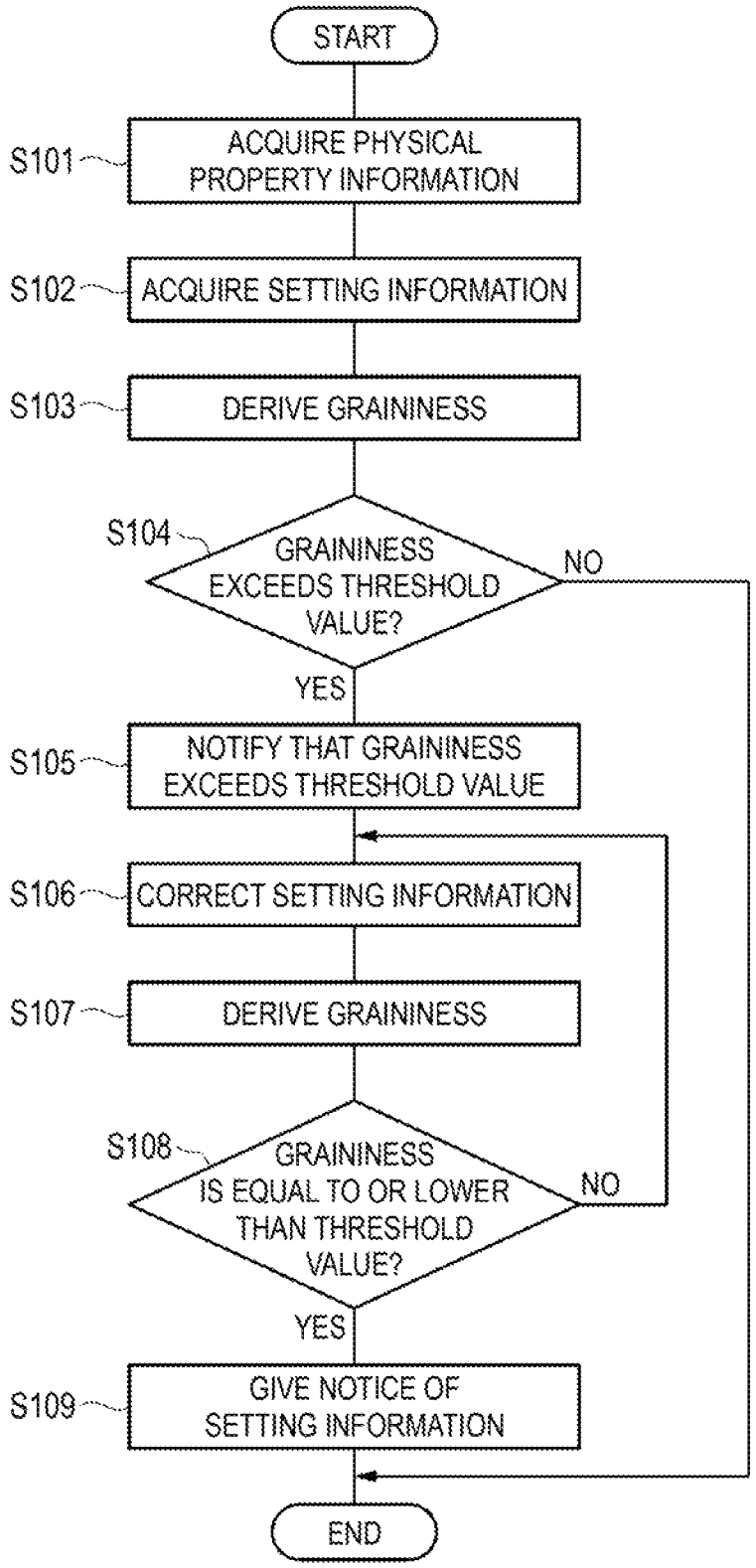
FIG. 8 is a flowchart showing an example of information processing according to the present exemplary embodiment.

Next, operation of the information processing program according to the present exemplary embodiment will be described with reference to FIG. 8. FIG. 8 is a flowchart showing an example of information processing according to the present exemplary embodiment. The CPU 1I reads the information processing program from the ROM 12 or the storage 14 and executes the information processing program to execute the information processing shown in FIG. 8. The information processing shown in FIG. 8 is executed when, for example, the user inputs an instruction to execute the information processing program.

In step S101, the CPU 11 acquires the physical property information.

In step S102, the CPU 11 acquires the setting information.

In step S103, the CPU 11 derives the graininess.

In step S104, the CPU 11 determines whether the graininess exceeds the threshold value. When the graininess exceeds the threshold value (step S104: YES), the CPU 11 proceeds to step S105. On the other hand, when the graininess does not exceed the threshold value (step S104: NO), the CPU 11 ends the processing.

In step S105, the CPU 11 notifies the user that the graininess exceeds the threshold value and the quality of the image to be formed is poor. Here, as the notification processing, a content to be notified may be displayed on a monitor, or the content to be notified may be transmitted to a terminal of the user.

In step S106, the CPU 11 corrects a value of the setting information and performs the correction set in the setting information. As an example, the setting information to be corrected is the image density and the printing speed. One of the image density and the printing speed may be corrected, or the image density and the printing speed may be corrected. A mode has been described in which the setting information to be corrected according to the present exemplary embodiment is the image density and the printing speed. However, the present invention is not limited thereto. For example, the volume of the ink to be ejected may be corrected.

In step S107, the CPU 11 derives the graininess using the corrected setting information.

In step S108, the CPU 1 determines whether the graininess is the threshold value or lower. When the graininess is the threshold value or lower (step S108: YES), the CPU 11 proceeds to step S109. On the other hand, when the graininess is higher than the threshold value (step S108: NO), the CPU 11 proceeds to step S106.

In step S109, the CPU 11 notifies the user of the corrected setting information.

The information processing program according to the present exemplary embodiment has described a mode in which the user is notified of the corrected setting information. However, the present invention is not limited thereto. For example, the corrected setting information may be set as setting information at a time of actually forming an image.

As described above, using the physical property information and the setting information, the feature quantity indicating the characteristics of the first and second drops of the ink is derived, and information on the graininess of the image is statistically derived. Therefore, according to the present exemplary embodiment, processing time for deriving the information on the graininess of the image to be formed on the recording medium is reduced as compared with a case of simulating the behavior of each ink for an entire region to be printed.

The configuration of the information processing apparatus 10 described in the above exemplary embodiment is an example, and may be changed depending on a situation without departing from the gist of the present disclosure.

The processing flow of the program described in the above exemplary embodiment is also an example, and an unnecessary step may be deleted, a new step may be added, or the processing order may be changed without departing from the gist of the present disclosure.

In the embodiments above, the term "processor" refers to hardware in a broad sense. Examples of the processor includes general processors (e.g., CPU: Central Processing Unit), dedicated processors (e.g., GPU: Graphics Processing Unit, ASIC: Application Integrated Circuit, FPGA: Field Programmable Gate Array, and programmable logic device).

In the embodiments above, the term "processor" is broad enough to encompass one processor or plural processors in collaboration which are located physically apart from each other but may work cooperatively. The order of operations of the processor is not limited to one described in the embodiments above, and may be changed.

In the above exemplary embodiment, instead of being stored (installed) in the storage medium 14 in advance, the program PR may be provided by being recorded in a recording medium such as a compact disc read only memory (CD-ROM), a digital versatile disc read only memory (DVD-ROM), and a universal serial bus (USB) memory, or may be downloaded from an external device via a network.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An information processing apparatus comprising a processor configured to:

acquire physical property information on physical properties of a recording medium and on physical properties of ink to be ejected onto the recording medium and setting information on a setting of a device configured to eject the ink onto the recording medium, the ink including a first ink and a second ink;

derive a feature quantity relating to characteristics of the ink based on behavior of the first ink to be ejected onto the recording medium and of the second ink to be ejected to a position adjacent to the first ink ejected, using the physical property information and the setting information;

derive, as the behavior, a first deviation amount indicating a deviation of a position of the first ink ejected onto the recording medium, a second deviation amount indicating a deviation of a position when the first ink and the second ink overlap, and an overlapping amount indicating an amount of overlapping when the first ink and the second ink overlap;

derive the first deviation amount using a wetting and spreading width of the first ink and a contact angle of the first ink; and output information on graininess of an image to be formed on the recording medium based on the feature quantity.

2. The information processing apparatus according to claim 1, wherein the processor derives, as the feature quantity, a size of a periodic ink aggregate formed by continuously overlapping the ink and a probability of forming the periodic ink aggregate.

3. The information processing apparatus according to claim 2, wherein the processor derives, as the behavior, a first deviation amount indicating a deviation of a position of the first ink ejected onto the recording medium, a second deviation amount indicating a deviation of a position when the first ink and the second ink overlap, and an overlapping amount indicating an amount of overlapping when the first ink and the second ink overlap.

4. The information processing apparatus according to claim 3, wherein the processor derives the first deviation amount using a wetting and spreading width of the first ink and a contact angle of the first ink.

5. The information processing apparatus according to claim 4, wherein the processor derives, as the feature quantity, a size of a periodic ink aggregate formed by continuously overlapping the inks and a probability of forming the periodic ink aggregate, and the processor derives the probability using the first deviation amount and the overlapping amount.

6. The information processing apparatus according to claim 5, wherein the processor derives the size of the periodic ink aggregate using the probability and the second deviation amount.

7. The information processing apparatus according to claim 3, wherein the processor derives, as the feature quantity, a size of a periodic ink aggregate formed by continuously overlapping the inks and a probability of forming the periodic ink aggregate, and the processor derives the probability using the first deviation amount and the overlapping amount.

8. The information processing apparatus according to claim 7, wherein the processor derives the size of the periodic ink aggregate using the probability and the second deviation amount.

9. The information processing apparatus according to claim 1, wherein the processor derives, as the feature quantity, a size of a periodic ink aggregate formed by continuously overlapping the inks and a probability of forming the periodic ink aggregate, and the processor derives the probability using the first deviation amount and the overlapping amount.

10. The information processing apparatus according to claim 9, wherein the processor derives the size of the periodic ink aggregate using the probability and the second deviation amount.

11. The information processing apparatus according to claim 1, wherein the processor derives the size of the periodic ink aggregate using the probability and the second deviation amount.

12. The information processing apparatus according to claim 1, wherein the processor further derives a visual characteristic for evaluating perception of the ink ejected onto the recording medium using the feature quantity, derives a value indicating the graininess based on the feature quantity and the visual characteristic, and outputs the information on the graininess depending on the value indicating the graininess.

13. The information processing apparatus according to claim 12, wherein, in a case where the value indicating the graininess exceeds a predetermined threshold value, the processor notifies a user that a quality of the image is poor.

14. The information processing apparatus according to claim 12, wherein, in a case where the value indicating the graininess exceeds a predetermined threshold value, the processor derives corrected setting information with which the value indicating the graininess is lower than the predetermined threshold value and gives notice of the corrected setting information.

15. The information processing apparatus according to claim 12, wherein, in a case where the value indicating the graininess exceeds a predetermined threshold value, the processor corrects the setting information to achieve the value indicating the graininess equal to or lower than the predetermined threshold value.

16. The information processing apparatus according to claim 15, wherein the processor corrects at least one of a printing speed and an image density included in the setting information to achieve the value indicating the graininess equal to or lower than the predetermined threshold value.

17. A non-transitory computer readable medium storing a program causing a computer to execute a process for information processing, the process comprising:

acquiring physical property information on physical properties of a recording medium and on physical properties of ink to be ejected onto the recording medium and setting information on a setting of a device configured to eject the ink onto the recording medium, the ink including a first ink and a second ink;

deriving a feature quantity relating to characteristics of the ink based on behavior of the first ink to be ejected onto the recording medium and of the second ink to be ejected to a position adjacent to the first ink ejected, using the physical property information and the setting information;

deriving, as the behavior, a first deviation amount indicating a deviation of a position of the first ink ejected onto the recording medium, a second deviation amount indicating a deviation of a position when the first ink and the second ink overlap, and an overlapping amount indicating an amount of overlapping when the first ink and the second ink overlap;

deriving the first deviation amount using a wetting and spreading width of the first ink and a contact angle of the first ink; and outputting information on graininess of an image to be formed on the recording medium based on the feature quantity.

* * * * *